US009174081B2

(12) United States Patent
Cecil

(10) Patent No.: US 9,174,081 B2
(45) Date of Patent: Nov. 3, 2015

(54) PORTABLE CHEST EXERCISE PAD

(71) Applicant: Craig R. Cecil, Westminster, MD (US)

(72) Inventor: Craig R. Cecil, Westminster, MD (US)

(73) Assignee: Cecil and Gloth, Westminster, MD (US)

( * ) Notice: Subject to any disclaimer, the term of this patent is extended or adjusted under 35 U.S.C. 154(b) by 122 days.

(21) Appl. No.: 13/896,834

(22) Filed: May 17, 2013

(65) Prior Publication Data

US 2014/0342888 A1 Nov. 20, 2014

(51) Int. Cl.

| | |
|---|---|
| ***A63B 26/00*** | (2006.01) |
| ***A47C 20/00*** | (2006.01) |
| ***A61G 15/00*** | (2006.01) |
| ***A63B 23/02*** | (2006.01) |
| ***A63B 21/00*** | (2006.01) |
| ***A63B 23/12*** | (2006.01) |
| *A47C 16/00* | (2006.01) |
| *A47C 7/42* | (2006.01) |
| *A61G 13/12* | (2006.01) |

(52) U.S. Cl.

CPC ..... *A63B 23/02* (2013.01); *A63B 21/1415* (2013.01); *A63B 23/12* (2013.01); *A47C 7/425* (2013.01); *A47C 16/00* (2013.01); *A61G 13/1225* (2013.01); *A61H 2201/0134* (2013.01)

(58) Field of Classification Search

CPC ..... A47C 16/00; A47C 7/425; A47C 16/005; A61G 13/1225; A61H 2201/0134; A63B 21/1415; A63B 23/12

USPC ..... 482/92–96, 104, 131, 140, 142; 5/630, 5/632–640; 128/845; 606/240

See application file for complete search history.

(56) References Cited

U.S. PATENT DOCUMENTS

| | | | | | |
|---|---|---|---|---|---|
| 1,386,652 | A | * | 8/1921 | Patton | 5/640 |
| 3,542,421 | A | * | 11/1970 | Ambrose | 297/230.12 |
| 4,230,099 | A | * | 10/1980 | Richardson | 606/240 |
| 4,474,370 | A | * | 10/1984 | Oman | 482/104 |
| 4,621,809 | A | * | 11/1986 | Pearl | 482/104 |
| 4,796,315 | A | * | 1/1989 | Crew | 5/630 |
| 4,905,993 | A | * | 3/1990 | Barone | 482/106 |
| 4,953,857 | A | * | 9/1990 | Lemire | 482/142 |
| 5,007,633 | A | * | 4/1991 | Lemire | 482/142 |
| 5,120,052 | A | * | 6/1992 | Evans | 482/145 |
| 5,147,260 | A | * | 9/1992 | Roosevelt | 482/104 |
| 5,207,704 | A | * | 5/1993 | Shields | 606/240 |
| 5,279,310 | A | * | 1/1994 | Hsien | 5/632 |
| 5,348,523 | A | * | 9/1994 | Blount | 482/104 |
| 5,447,481 | A | * | 9/1995 | Emter, Jr. | 482/104 |
| 5,474,513 | A | | 12/1995 | Carlesimo | |
| 5,584,786 | A | * | 12/1996 | Almeda | 482/142 |

(Continued)

FOREIGN PATENT DOCUMENTS

GB 2413502 A * 11/2005

*Primary Examiner* — Oren Ginsberg
*Assistant Examiner* — Joshua Lee
(74) *Attorney, Agent, or Firm* — Garrett IP, LLC

(57) ABSTRACT

A portable chest exercise pad for exercise has a convex pad having upper and lower tapered ends, a flat bottom surface extending between the upper and lower tapered ends, a convex top surface separated from the bottom surface, the convex top surface having an apex between opposing upper and lower inclined surfaces that rise respectively from the upper and lower tapered ends toward the apex, and left and right sides extending between the upper and lower tapered ends and separated from each, the left and right sides having opposing cutout regions positioned so that a width of the convex pad increases moving in the length direction from the apex toward the upper tapered end.

10 Claims, 7 Drawing Sheets

(56) References Cited

U.S. PATENT DOCUMENTS

| | | | | | |
|---|---|---|---|---|---|
| 5,649,886 | A * | 7/1997 | Danylieko | 482/142 |
| 5,692,246 | A * | 12/1997 | Benedick | 2/463 |
| 5,702,333 | A * | 12/1997 | Waldron et al. | 482/131 |
| D396,078 | S * | 7/1998 | Atashkarian et al. | D21/668 |
| 5,774,916 | A * | 7/1998 | Kurhi | 5/632 |
| 5,795,276 | A | 8/1998 | Almeda | |
| 5,807,220 | A * | 9/1998 | Allis et al. | 482/140 |
| 5,996,583 | A * | 12/1999 | King | 128/845 |
| 6,015,370 | A | 1/2000 | Pandozy | |
| 6,634,999 | B2 * | 10/2003 | Herbst | 482/142 |
| 6,899,662 | B2 * | 5/2005 | Gamble et al. | 482/142 |
| 7,153,249 | B2 | 12/2006 | O'Connor | |
| 7,288,077 | B2 * | 10/2007 | Notestine | 602/19 |
| 7,634,829 | B1 * | 12/2009 | La Bar | 5/632 |
| 7,665,165 | B2 | 2/2010 | Maganov | |
| 2006/0040811 | A1 | 2/2006 | Foster | |
| 2009/0236888 | A1 | 9/2009 | Chew | |
| 2010/0197471 | A1 | 8/2010 | Hayes | |
| 2010/0319132 | A1 * | 12/2010 | Li | 5/636 |
| 2011/0136635 | A1 * | 6/2011 | Berc | 482/142 |
| 2012/0023663 | A1 * | 2/2012 | Batiste et al. | 5/421 |
| 2012/0280545 | A1 * | 11/2012 | Vernon | 297/230.1 |
| 2014/0190488 | A1 * | 7/2014 | Robran et al. | 128/845 |

* cited by examiner 100
142a
110
505
106
112

PORTABLE CHEST EXERCISE PAD

BACKGROUND

The present invention relates generally to exercise pads.

Physical fitness is a continually growing activity for the general public. Older, as well as younger, generations are becoming more health conscious and trying to keep in better shape. Muscle mass in the chest is one of the most common areas of the human body that many attempt to increase and strengthen. Many existing devices focus on strengthening and increasing such muscle mass of the chest, but with suboptimal results.

Bench presses and flys, performed with barbells and dumbbells, are one of the most popular forms of exercise involving the chest muscles (pectorals). These exercises are typically performed on exercise benches that are set at a supine, incline or decline angular position.

However, while these exercises performed on exercise benches provide some activation of the chest muscles, they do not provide optimal activation of those muscles, due to suboptimal interaction of the shoulder muscles with the chest muscles cause in part by suboptimal position of the users scapula relative to the chest (sternum) while exercising. There is a need, therefore, for an exercise pad attachment to exercise benches that provides a more optimal activation of the chest muscles, while allowing a user to continue using standard equipment, e.g., benches, and exercises.

SUMMARY

A chest exercise pad is presented. The chest exercise pad aids the user in performing a variety of more direct pectoral exercises than is possible with conventional exercises pads.

The chest exercise pad is easily attached to an existing exercise bench, e.g., in supine, incline, and decline positions, for aiding a user in performing various pectoral exercises. When the exercise pad is attached to a bench, due to the configuration of the exercise pad as will become apparent from the ensuing description, a user is able to enjoy a more challenging exercise session. The user is also able to isolate and develop a specific set of muscles more optimally than with other conventional exercise pads.

The chest exercise pad can be adjusted to fit a wide range of different sized existing exercise benches.

The chest exercise pad alternatively permits a user to use the pad without an exercise bench, e.g., by placing the pad directly on any support surface, such as a floor.

The chest exercise pad can be quickly and conveniently attached and removed from an exercise bench, and transported.

In an embodiment, a portable chest exercise pad for supporting a user during exercise, comprises a convex pad having upper and lower tapered ends separated in a length direction, a flat bottom surface extending between the upper and lower tapered ends, a convex top surface separated from the bottom surface in a height direction, the convex top surface having an apex between opposing upper and lower inclined surfaces that rise respectively from the upper and lower tapered ends toward the apex, and left and right sides extending between the upper and lower tapered ends and separated from each other in a width direction, the left and right sides having opposing cutout regions positioned so that a width of the convex pad increases moving in the length direction from the apex toward the upper tapered end, whereby, when the user lies back on the convex pad during exercise, the convex top surface elevates the user's sternum relative to the user's scapulas which are retracted into the cutout regions.

Other features and advantages of the chest exercise pad are apparent from the following description and accompanying Figures, which are illustrative, only, and not limiting or restricting in any way.

BRIEF DESCRIPTION OF THE DRAWINGS/FIGURES

DETAILED DESCRIPTION

Figure 1:
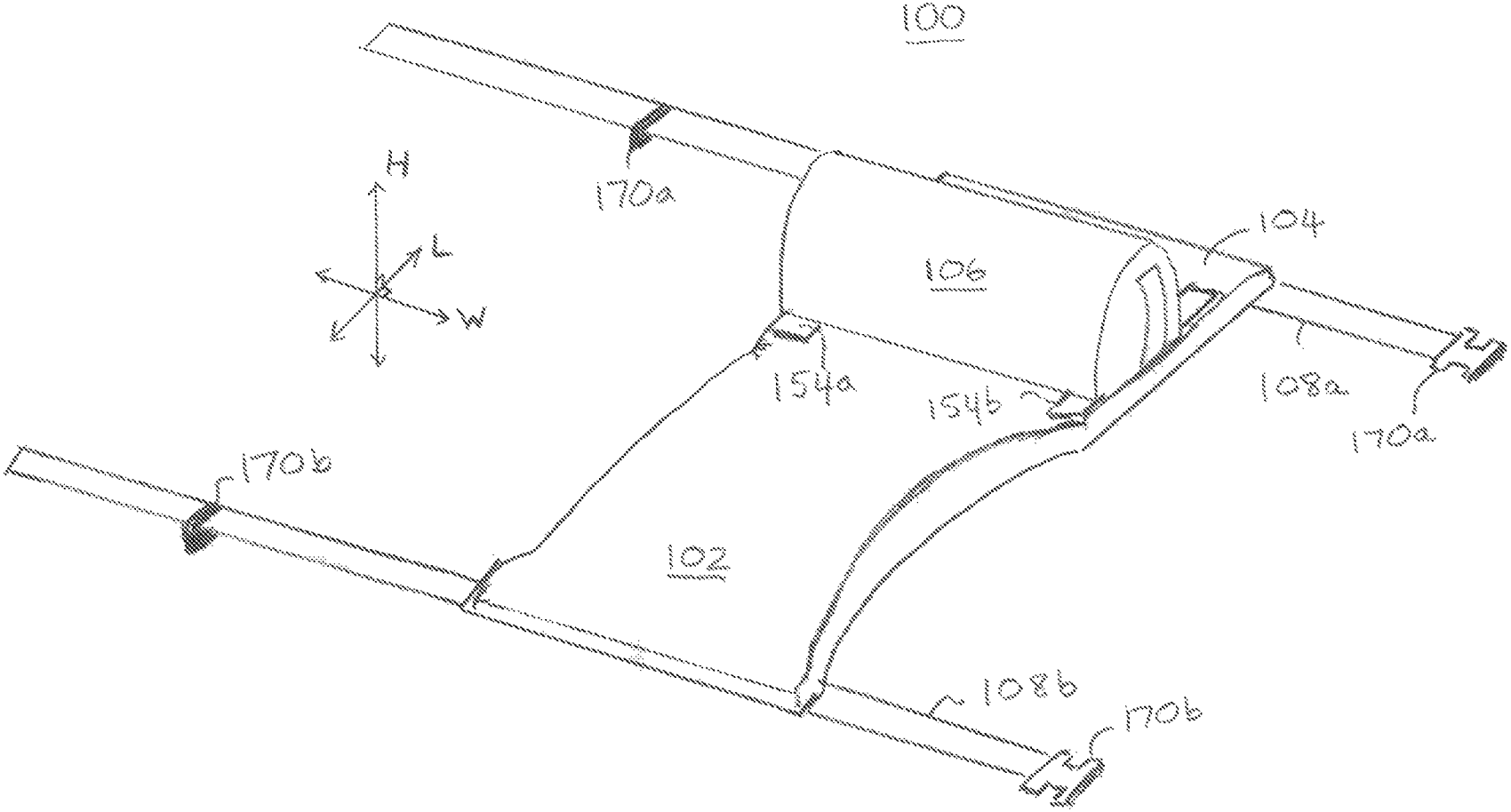
FIG. 1 is a perspective elevation view of an exemplary chest exercise pad.
Figure 2:
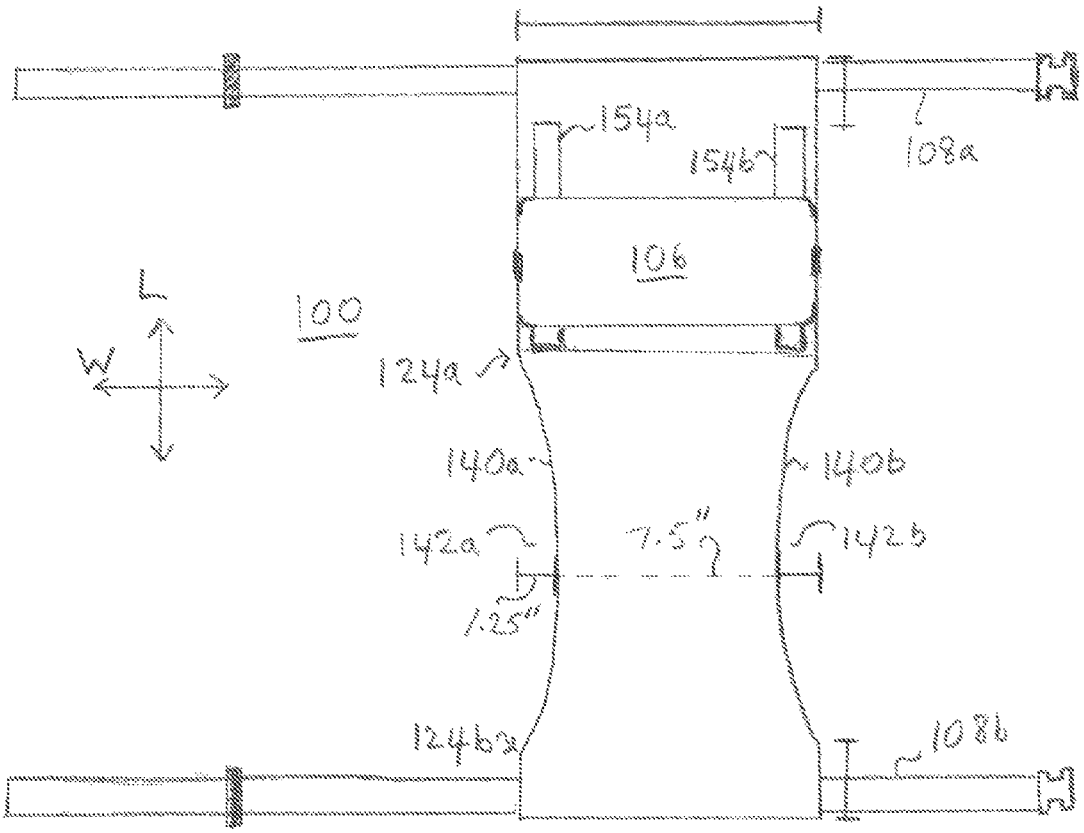
FIG. 2 is a top elevation view of the exercise pad.
Figure 3:
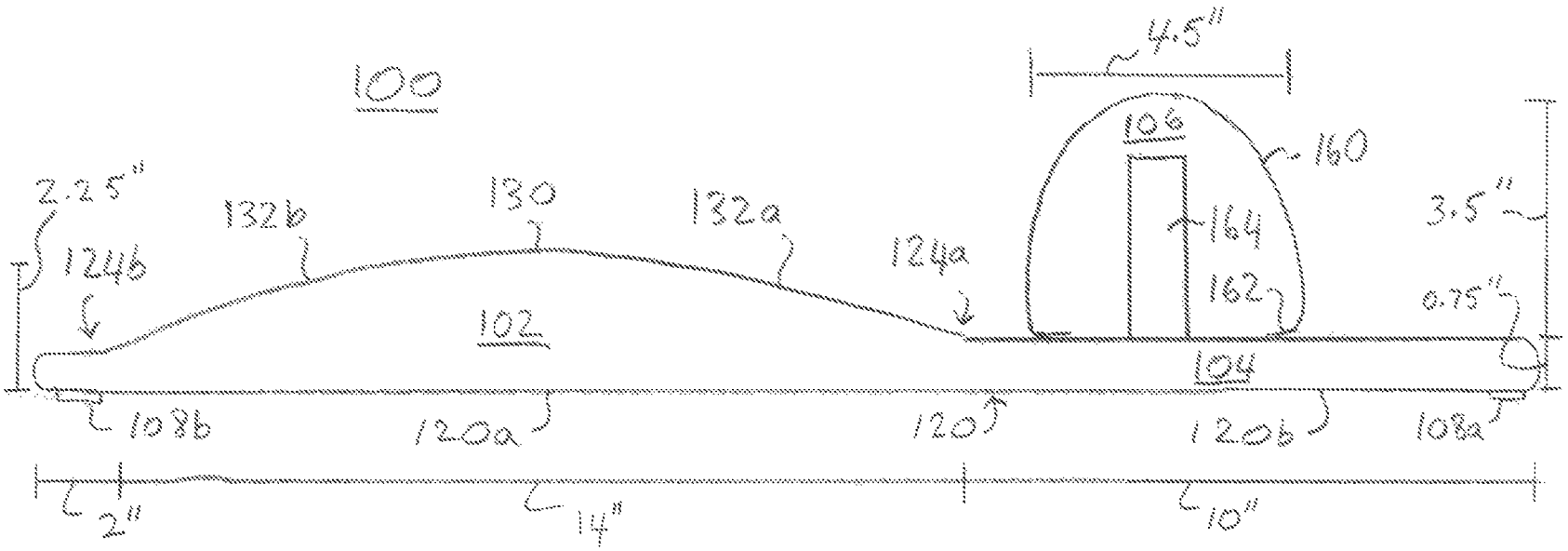
FIG. 3 is a side elevation view of the exercise pad.

The relative terms "left" and "right," "lower" and "upper," and "top" and "bottom," as used herein, are may be used interchangeably with equivalent relative terms such as "first" and "second," respectively. Depicted in FIGS. 1-3 is an exemplary portable chest exercise pad 100 upon which an individual lies when performing different chest exercises. Exercise pad 100 may be conveniently and easily attached to and removed from exercise benches of different dimensions. Width, length, and height (or thickness) dimensions of exercise pad 100 are respectively aligned with orthogonal width (W), length (L), and height (H) directions, depicted in FIGS. 1-3. The length, width, and height dimensions of chest exercise pad 100 depicted in the Figures and listed herein in inches are exemplary and approximate, and matched to an average adult user. Other suitable dimensions are possible, as would be appreciated by those having skill in the relevant arts.

Figure 5:
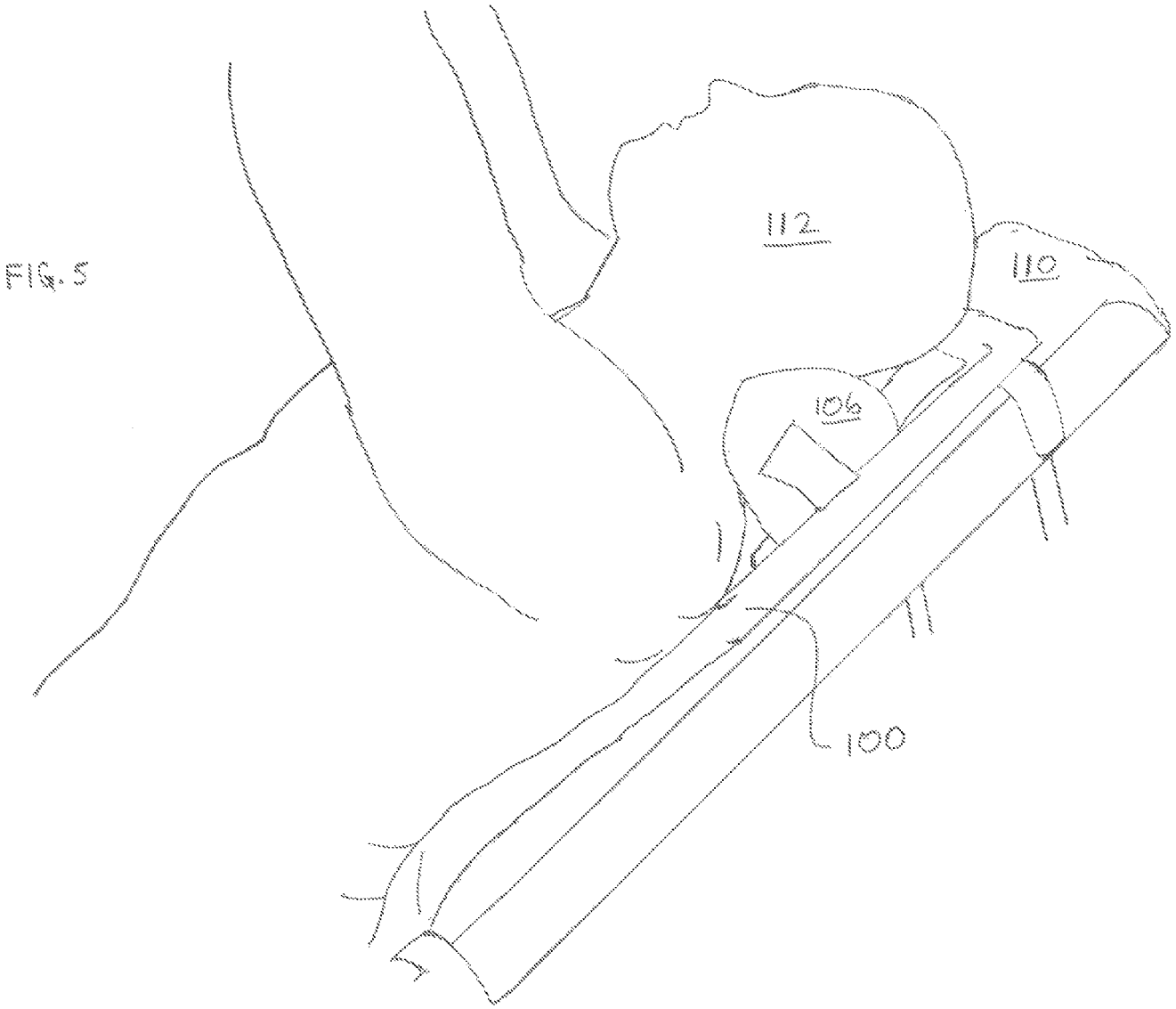
FIG. 5 is a perspective view of the exercise pad of FIG. 4, with a user lying back on the pad while performing chest exercises.
Figure 6:
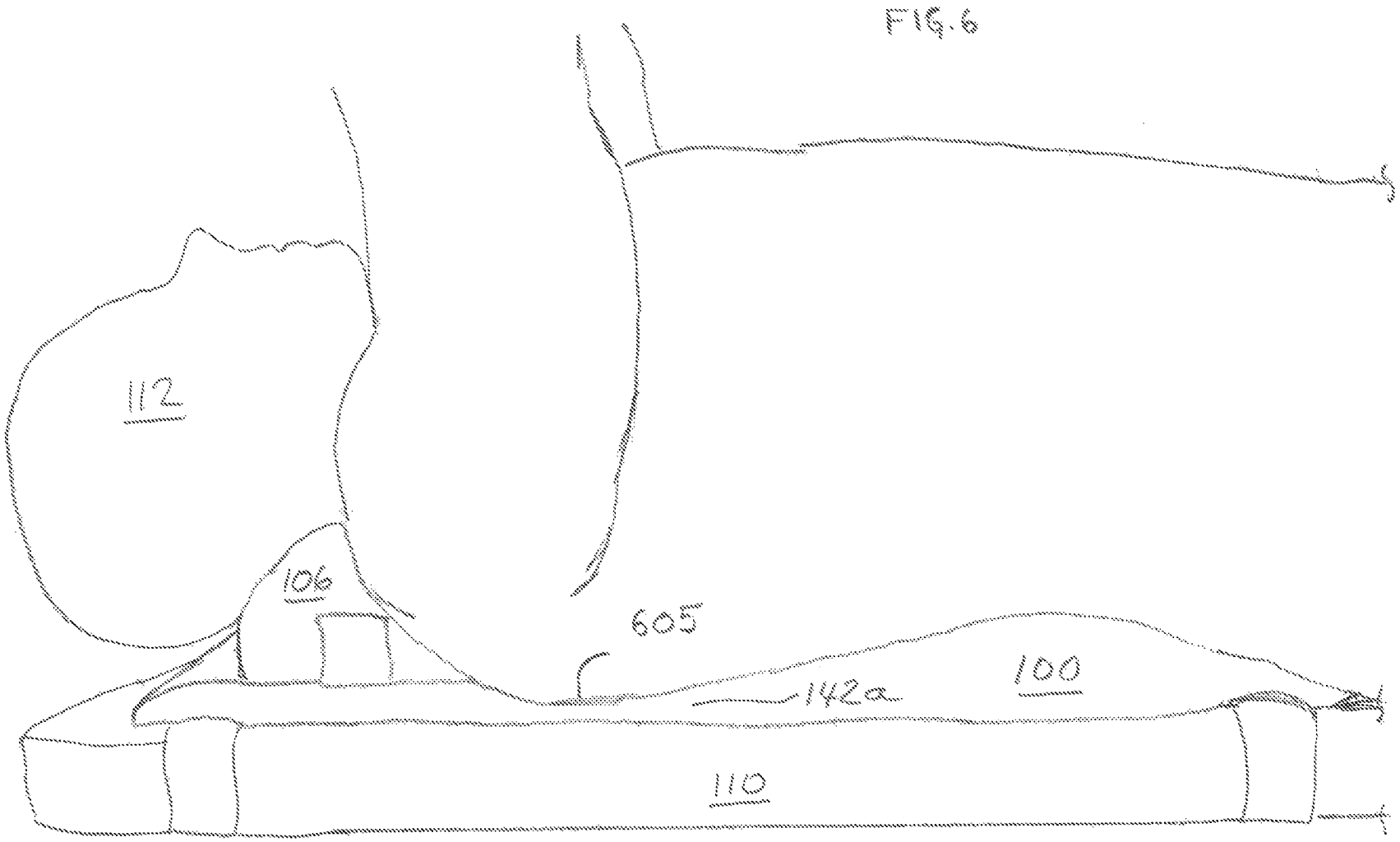
FIG. 6 is a perspective view of the exercise pad attached to a horizontal exercise bench, with a user lying back on the exercise pad while performing chest exercises.

Exercise pad 100, generally rectangular in shape and elongated along its length, i.e., in the length direction L, includes a convex pad portion 102, a flat pad portion 104 adjacent the convex pad, a selectively attachable/removable neck pad portion (or neck support cushion) 106, and attachment straps 108*a* and 108*b* for attaching the exercise pad to an exercise bench 110 (see FIG. 4) or other support surface. The term "pad portion" is also referred to herein simply as "pad." As depicted in FIGS. 5 and 6, when a user 112 lies back on exercise pad 100 during exercise, pad 100 is sized, shaped, and configured such that convex pad 102 supports a curved portion of the user's spine beneath the sternum, while flat pad 104 and neck pad 106 together support the user's neck and head. Pad 100 is constructed with length, width and height dimensions that are matched to an average adult user, but may be reduced or increased in different combinations for different sized users.

Convex Pad

With reference to FIG. 3, exercise pad 100 has a substantially planar, generally rectangularly shaped, bottom surface 120 extending the entire length of the exercise pad, so as to form contiguous bottom surfaces 120*a* and 120*b* of convex pad 102 and adjacent flat pad 104, respectively. Bottom surface 120 rests against any support surface, such as a floor or an exercise bench surface, upon which exercise pad 100 lies. Convex pad 102 includes bottom surface 120*b*, which extends between an upper (or first) tapered end 124*a* and a lower (or second) tapered end 124*b* of the convex pad separated from each other in the length direction. Convex pad 102 also includes a convex top surface 128 having an apex 130 between opposing upper and lower inclined surfaces 132*a*, 132*b* that rise respectively from upper and lower tapered ends 124*a*, 124*b* toward the apex. Accordingly, the height or thickness of convex pad 102 increases gradually and continuously from minimums at each of tapered ends 124*a*, 124*b* to a maximum at apex 130.

With reference to FIGS. 2 and 3, convex pad 102 also includes left and right, preferably symmetrical, concave or inwardly directed arcuate sides 140*a*, 140*b* extending between the upper and lower tapered ends 124*a*, 124*b* and separated from each other in the width direction. Left and right sides 140*a*, 140*b* define opposing cutout regions 142*a*, 142*b* shaped and positioned so that the width of convex pad 102 has an hour-glass shape, i.e., the width of the convex pad gradually and continuously increases, moving in the length direction, from a minimum at apex 130 to maximums at each of tapered ends 124*a*, 124*b*. Therefore, while the width of convex pad 102 gradually increases along the length of the pad from the apex 130 toward opposing ends 124*a*, 124*b*, in contrast, the height or thickness of the convex pad coincidentally gradually decreases over that same length (from the apex to each of the tapered ends). This narrower center width of convex pad 102 coinciding with apex 130 allows users of differing body girth widths to lie back upon the convex pad and be supported optimally while the pad provides maximum stabilization at the wider portions at tapered ends 124*a*, 124*b*. The importance of cutout regions 142*a*, 142*b* will become apparent.

When the user lies back on convex pad 102 during exercise such that convex pad 102 is directly beneath the user's sternum, convex top surface 128 elevates the user's sternum relative to the user's scapulas, which become retracted into opposing cutout regions 142*a*, 142*b* during certain chest exercises (see FIG. 6). The width of convex pad 102 in the narrowed region thereof is sized so that the left and right cutout regions 142*a*, 142*b* will coincide with the left and right scapulas of an average sized (or larger than overage sized user when the user is lying back and centered on the convex pad. This arrangement substantially enhances the effectiveness of chest exercise on the user's pectoral muscles. In other words, while the user is in the exercise position, the user's sternum, and therefore chest, is projected slightly upward while the user's shoulders become slightly retracted, providing for a more direct involvement of the pectoral muscles while reducing the involvement of the shoulder muscles.

As would be appreciated by those skilled in the relevant arts, convex pad 102 may have any conventional construction for an exercise pad including, e.g., a solid, molded plastic form having a convex shape consistent with the shape described above. The molded form is covered with dense, compressible foam, for comfortably supporting the user's back, as found in standard exercise benches, over which is provided a stitched pliant/flexible covering for comfort and durability. Exemplary approximate dimensions of convex pad 102 are as follows:

Length 14";

Width 10" at tapered ends 124, and 7.5" in the narrowed middle, i.e., coinciding with apex 130; and Heights 2.25" at apex 130, and 0.75" at the tapered ends.

Flat Pad and Neck Pad

Flat pad 104 comprises bottom surface 120*b* and a flat top surface 152 separated from each other in the height direction and generally parallel to each other, to form a substantially square pad. Flat pad 104 is constructed from conventional material, including, e.g., a foam core, over which is provided a comfortable, flexible covering. Flat pad 104 includes elongated, spaced apart in a generally parallel configuration along the length direction, attachment strips or rails 154*a*, 154*b* fixed to top surface 152. Exemplary approximate dimensions of flat pad 102 are as follows:

Length 10";

Width 10"; and

Height 0.75".

Neck pad 106, approximately cylindrical in shape, has a top curved surface 160 sized and shaped to fit the curvature of the user's neck. Neck pad 106 is constructed with any suitable, conventional covered cushion material. Neck pad 106 has a bottom surface 162 to which is fixed an elongated attachment strip 164 so that the strip is parallel with an axis of the neck pad. Attachment strip 164 of neck pad 106 and attachment strips 154*a*, 154*b* of flat pad 104 are complementary to each other, such as hook and loop type fasteners, e.g., Velcro™, so that neck pad 106 may be easily attached to and removed from flat pad 104 via the attachments 154 and 164. As depicted in FIGS. 1-3, neck pad 106 attaches to flat pad 104 such that the attachments 154 and 164 are substantially orthogonal to each other. Therefore, given the size, shape, and arrangement of the attachments 154 and 164, neck pad 106 may be conveniently attached at a variety of positions along the lengths of attachment straps 154 (and thus, along the length of flat pad 104) so as to accommodate user's of different heights and neck sizes. Exemplary approximate dimensions of neck pad 106 are Length (in the width direction W in the Figures) 4.5", Width (in the length direction L in the Figures) 10", and Height 3.5".

Attachment Straps

Figure 4:
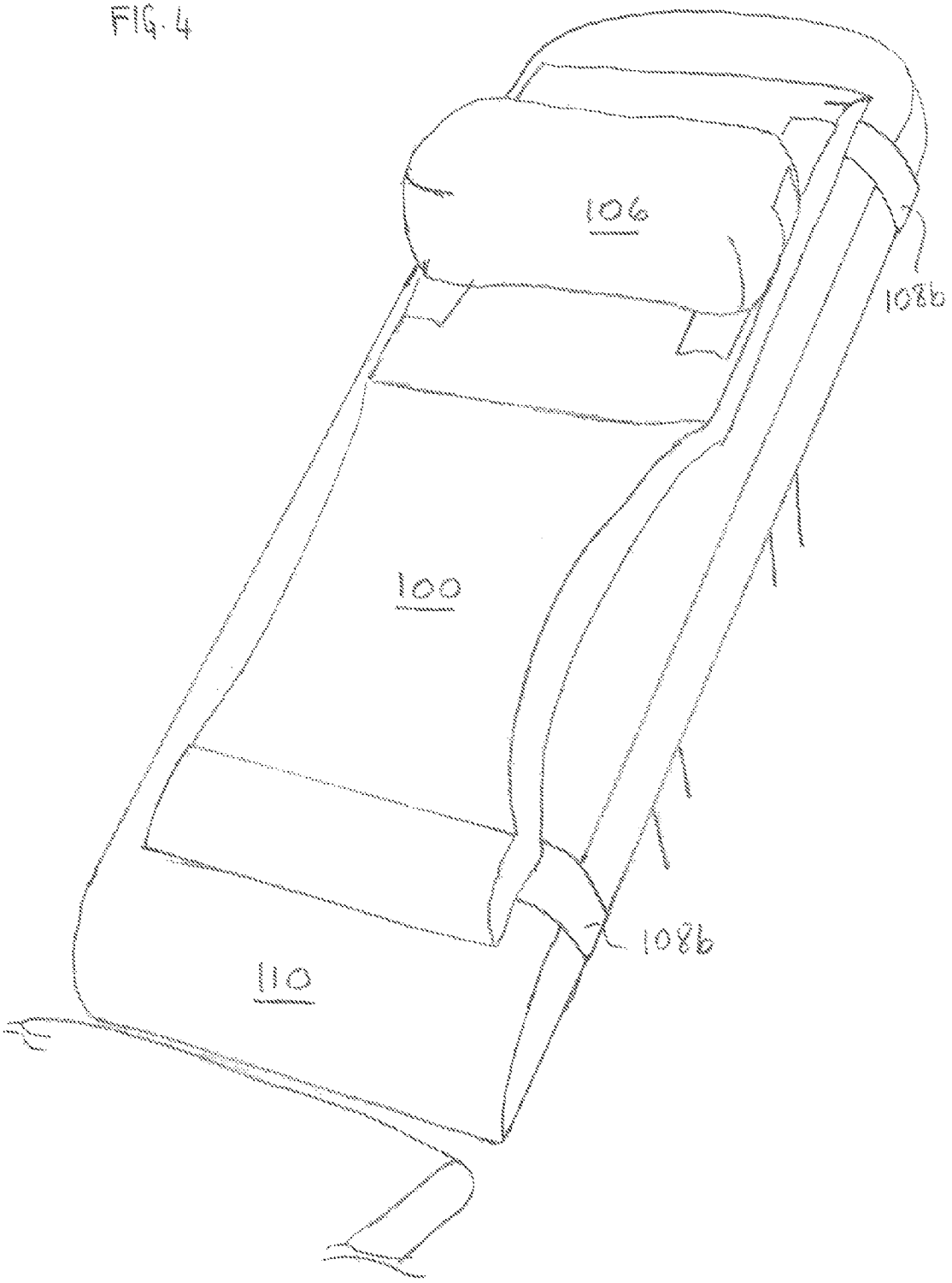
FIG. 4 is a perspective view of the exercise pad attached to an inclined exercise bench.

Exercise pad 100 includes adjustable attachment straps 108*a* and 108*b*, fixed respectively to end portions of bottom surfaces 120*a* and 120*b*, for strapping the exercise pad to an exercise bench, e.g., as depicted in FIGS. 4 and 6. Straps 108*a* and 108*b* each include a pair of complementary snap-together connectors 170*a* and 170*b*, and may be adjustable in length via the connectors so as to be able to secure exercise pad 100 to exercise benches having a range of widths. Connectors 170*a*, 170*b* may be replaced with any suitable known connection/attachment mechanism, including hook and loop fasteners, such as Velcro™. In the exemplary arrangement of FIG. 4, straps 108*a*, 108*b* are wrapped around bench 110 so as to secure exercise pad 110 to the bench.

Bench Views

FIG. 5 is a perspective view of chest exercise pad 100 attached to inclined bench 110 and user 112 lying back on the exercise pad while performing chest exercises.

FIG. 6 is a perspective view of chest exercise pad 100 attached to horizontally positioned bench 110 and user 112 lying back on the exercise pad while performing chest exercises. The user's scapula 605 is retracted into cutout region 142*a* while the user performs a bench press.

In other embodiments of the invention, neck cushion 106 may be omitted and flat pad 104 may be shortened or eliminated, leaving only convex pad 102.

Figure 7:
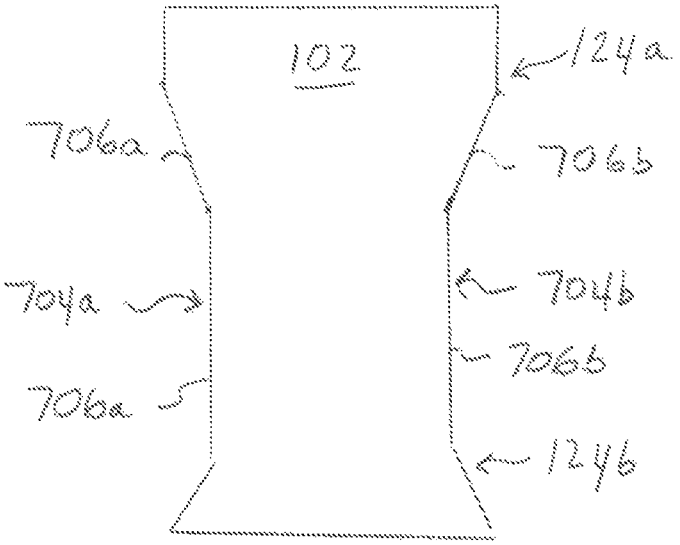
FIG. 7 is an illustration of another example arrangement of the exercise pad similar to the view in FIG. 2.

Also, in other embodiments, each of sides 140*a*, 140*b* may be formed of multiple straight, angled edges rather than an arcuate edge, or as a combination thereof. With reference to FIG. 7, left, right sides 704*a*, 704*b* include angled straight edges 706*a*, 706*b* adjacent upper tapered end 124*a*, which then lead to straight edges 706*a*, 706*b*, which terminate in a angled straight edges adjacent lower tapered end 124*b*.

In other embodiments, flat pad 104 is shaped as a rectangle, oval, or circle.

While various embodiments are disclosed herein, it should be understood that they have been presented by way of example only, and not limitation. It will be apparent to persons skilled in the relevant art that various changes in form and detail may be made therein without departing from the spirit and scope of the embodiments disclosed herein. Thus, the breadth and scope of the claims should not be limited by any of the example embodiments.

What is claimed is:

1. A portable chest exercise pad, comprising:

a convex pad having upper and lower tapered ends separated in a length direction, a flat bottom surface extending between the upper and lower tapered ends, a convex top surface separated from the bottom surface in a height direction, the convex top surface having an apex between opposing upper and lower inclined surfaces that rise respectively from the upper and lower tapered ends toward the apex, and left and right concave sides extending between the upper and lower tapered ends and separated from each other in a width direction so that a width of the convex pad gradually and continuously increases, moving in the length direction, from a minimum coinciding with the apex to maximums at the tapered ends, wherein the height of the convex pad gradually decreases while the width thereof gradually increases from the minimum coinciding with the apex to the maximums at the tapered ends;

a flat pad adjacent to the upper tapered end of the convex pad; and a neck cushion sized and shaped to support the user's neck, the flat pad and the neck cushion each having fixed thereto an attachment mechanism to removably attach the neck cushion to the flat pad, whereby, when the user lies back on the convex pad during exercise, the convex top surface elevates the user's sternum relative to the user's scapulas which are retracted into the cutout regions, and the upper and lower tapered ends support the user's upper and lower back, respectively.

2. The exercise pad of claim 1, wherein the flat pad and the upper tapered end are contiguous, the flat pad includes a top surface having fixed thereto one or more flat pad attachment strips, and the neck pad has fixed thereto one or more neck pad attachment strips removably attachable to the one or more flat pad attachment strips.

3. The exercise pad of claim 2, wherein the one or more flat pad attachment strips include elongated, spaced apart, first and second flat pad attachment strips, and the one or more pad attachment strips include neck pad attachment strips removably attachable to the first and second flat pad attachment strips.

4. The exercise pad of claim 1, further comprising adjustable straps with connectors for releasably attaching the exercise pad to a support surface.

5. The exercise pad of claim 4, wherein the adjustable straps with connectors comprise:

a first pair of adjustable straps with buckles attached to the flat pad; and a second pair of adjustable straps with buckles attached adjacent to the lower tapered end of the convex pad.

6. The exercise pad of claim 1, wherein the convex pad has a width that decreases from a maximum of approximately 10 inches at the upper and lower tapered ends down to a minimum of approximately 7.5 inches at the apex of the convex top surface.

7. The exercise pad of claim 6, wherein the convex pad has a length of approximately 14 inches from the upper tapered end to the lower tapered end.

8. The exercise pad of claim 6, wherein the upper flat pad has a width and a length of approximately 10 inches.

9. The apparatus of claim 1, wherein the convex pad terminates in the length direction at the lower tapered end.

10. The apparatus of claim 9, wherein the convex pad and the upper flat pad have approximate lengths of 14 and 10 inches, respectively, and the portable chest exercise pad has an approximate length of 24 inches.

* * * * *